US006736905B2

(12) United States Patent
Smith et al.

(10) Patent No.: US 6,736,905 B2
(45) **Date of Patent: *May 18, 2004**

(54) METHOD OF REMOVING MATERIAL FROM AN INTERIOR SURFACE USING CORE/SHELL PARTICLES

(75) Inventors: Dennis E. Smith, Rochester, NY (US); Christopher J. Puccini, Rochester, NY (US); David W. Gruszczynski, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 80 days.

This patent is subject to a terminal disclaimer.

(21) Appl. No.: 10/082,508

(22) Filed: Oct. 19, 2001

(65) Prior Publication Data

US 2003/0102011 A1 Jun. 5, 2003

(51) Int. Cl.[7] ..... B08B 9/04

(52) U.S. Cl. ..... 134/8; 134/22.12; 51/295; 51/298; 451/40

(58) Field of Search ..... 134/8, 22.12, 22.13, 134/22.14, 6, 7; 51/295, 298; 451/38, 39, 40

(56) References Cited

U.S. PATENT DOCUMENTS 4,115,076 A * 9/1978 Hitzrot, Jr. ..... 51/295
4,380,477 A * 4/1983 Saunders ..... 134/7
4,572,744 A 2/1986 Dominick
4,575,396 A * 3/1986 Matsumoto et al. ..... 134/7
4,731,125 A * 3/1988 Carr ..... 134/7
4,968,447 A 11/1990 Dixon et al.
5,234,470 A 8/1993 Lynn et al.
5,505,749 A 4/1996 Kirschner et al.
5,509,971 A 4/1996 Kirschner
5,616,183 A * 4/1997 Dieter et al. ..... 134/8
6,001,188 A * 12/1999 Walsh et al. ..... 134/7
2003/0077984 A1 * 4/2003 Smith et al. ..... 451/38

* cited by examiner

*Primary Examiner*—Randy Gulakowski
*Assistant Examiner*—Saeed Chaudhry
(74) *Attorney, Agent, or Firm*—Chris P. Konkol

(57) ABSTRACT

This invention relates generally to methods for removing adherent materials, for example, residues, scale, contaminants, fouling, precipitates, and the like objectional materials from various internal surfaces of fluid transport or delivery systems and parts thereof. In particular, the method employs an improved media comprising core/shell particles. The media can be propelled against or along the surface by a fluid carrier to remove the unwanted surface material. In one embodiment, the media may be propelled by a liquid along a surface, such as the interior walls of a pipe, to remove undesirable adherent materials.

23 Claims, 2 Drawing Sheets

METHOD OF REMOVING MATERIAL FROM AN INTERIOR SURFACE USING CORE/SHELL PARTICLES

FIELD OF THE INVENTION

This invention relates generally to methods for removing adherent materials, for example, undesirable residues, precipitates, scale and other materials from internal surfaces such as pipes and tanks, especially internal surfaces used to transport or deliver liquids in closed systems. In particular, the method employs an improved cleaning media comprising core/shell particles.

BACKGROUND OF THE INVENTION

For various types of structures, it is often desirable to remove a coating that has been formed on an interior surface area. Numerous techniques exist for removing paint, rust, scale, biogrowth and other adherent materials from virtually any type of surface. Surface cleaning or stripping methods range from mechanical abrasion to the use of strong chemicals and involve varying degrees of time, effort and expense. This invention relates to compositions and methods for removing unwanted deposits or build-up on surfaces of internal surfaces in fluid delivery/transport systems (referred to herein as "fluid transport systems") or parts thereof, including conduits, tanks, and related equipment, for example, the throughput parts of pumps. The invention is particularly useful for cleaning substantially closed systems. Large quantities of fluids with suspended, dispersed or dissolved materials (hereinafter referred to as "carried materials") are often circulated through fluid transport systems and over time the material may deposit or settle on various interior surfaces of the fluid transport system. For example, paints, inks, or components thereof are circulated or re-circulated in piping of delivery systems in industrial manufacturing plants. During the course of normal operation, the carried materials in a fluid may build up or deposit on the inside of fluid delivery systems, especially in areas of reduced flow such as in filters, tees, elbows and valves. As a consequence fluid delivery systems are cleaned on a periodic basis to remove the unwanted carried materials adhering to the insides of pipes, tubing, filters and/or valves. Since these systems are enclosed, at least to a substantial extent, removal of unwanted material adhering to the insides of tubes, pipes and other conduits is difficult to achieve because access is difficult, and, in fact, frequently it is difficult even to determine the extent of cleaning.

Industrial applications where internal surfaces need to be cleaned include, for example, food (e.g. dairy and beverages), pharmaceuticals, inks and pigments, paints, oil pipelines, oil refinery lines, power plants, marine lines in ships, and polymer and chemical manufacturing pipelines in general.

For example, coating or paint delivery systems are utilized for the finishing of a wide variety of manufactured items such as motor vehicles, household appliances and the like. A typical industrial paint delivery system may comprise a central paint supply having a number of painting stations communicating therewith. Such paint delivery systems can selectably deliver a variety of different paints to a given painting station and include complex fluid pathways involving various tanks, pumps and conduits. These paint delivery systems tend to become clogged with encrustations in the course of their use and such deposits can decrease and even block the flow of paint there through. Such clogging is occasioned by deposits of pigment, resins or other components of the paint within the tanks and lines of the system. In addition to causing clogging, such deposits can also contaminate the paint color, and can cause surface defects in the finished, painted product. Cleaning the paint delivery system reduces the amount of surface repairs to paint finishes. The build-up of residues necessitates periodic cleaning of paint delivery systems and because of the complexity of the systems and the necessity of avoiding expensive downtime, it is generally preferable that such systems be cleaned without or with minimum disassembly. The prior art approach to cleaning involves passing a variety of solvents, detergents or other cleaners through the system, and tends to involve numerous steps and multiple compositions. It should be noted that these processes often do not provide full removal of deposits, particularly pigment residues.

A typical prior art process can involve flushing five or more different cleaning compounds of varying polarity through the paint system and can include 30 separate operational steps. The numerous cleaning compounds are needed in order to fully remove the residues in the system and to ensure compatibility of any cleaner residue remaining in the system with subsequently introduced paint. As a result, the system must be sequentially rinsed with various materials in a predetermined order such that the final rinse is with a paint-compatible thinner. Clearly, it would be most advantageous to reduce the number of steps by utilizing a cleaning composition which is fully paint-compatible, and to improve the efficiency of the process by utilizing a composition capable of removing all residues. In addition to toxicity and waste disposal problems, another of the shortcomings of prior-art paint system cleaning, especially ones requiring organic solvents, is that they do not provide sufficient cleaning action, particularly with regard to encrusted pigment deposits and, as a consequence, long flush times and/or repeated cleaning cycles have been generally required.

It has been known to utilize abrasive materials to clean closed lines and one such process is disclosed in U.S. Pat. No. 4,572,744 which describes the use of sand or similar material entrained in a flow of air to clean the interior of boiler tubes. Also mentioned in the '744 patent is the similar use of liquid based abrasive slurries to clean pipes. Various attempts have been made to utilize abrasive based materials for cleaning paint lines and it is known to employ mica, or sand particles in conjunction with a flush liquid to scour the interior of paint lines. Problems have arisen with the use of such inorganic abrasives insofar as they can be relatively hard and tend to damage or clog pumps and passageways through which they flow. Additionally, such inorganic abrasive materials are also relatively dense and tend to settle out of a cleaning fluid unless vigorous agitation is maintained or thickeners are added to increase the solution viscosity.

For example, it is known to utilize a specific paint system cleaning composition comprised of sand or mica suspended in a solution of xylene and methyl isobutyl ketone thickened with a resinous material. Compositions of this type present problems insofar as the resin and abrasive are difficult to rinse from the system thereby presenting problems of contamination, particularly when the resin is not compatible with subsequently employed paint compositions. Additionally, the viscous composition presents problems of waste disposal insofar as the resin is difficult to incinerate and inhibits the ready evaporation and recovery of the xylene and ketone. Obviously, the inorganic abrasive residue presents significant waste disposal problems insofar as it cannot be readily incinerated.

U.S. Pat. No. 4,968,447, to Dixon and Maxwell, proposes the use of polymeric particulates made of polypropylene, polyethylene, polyvinylchloride, polytetrafluoroethylene, and various other hydrophobic organic polymers and copolymers.

Organic, polymeric materials are not generally thought of as being abrasive; however the present invention relies in part upon the counter intuitive finding that organic materials can function very well to facilitate the cleaning of encrustations from paint delivery systems. Dixon et al. utilize polymeric particles of relatively low density that can be maintained in suspension without resort to thickeners or vigorous agitation. Dixon et al. state that, although these organic materials perform an excellent job of cleaning residues from paint lines, they are not sufficiently abrasive to damage pumps, valves and the like.

The rheological additive "Viscotrol", available from Mooney Chemicals, Inc. of Cleveland, Ohio, has been described as a particulate derivative of castor oil, apparently lightly crosslinked, which may be added to a re-circulating paint cleaning system to act as a mild abrasive. After use, their removal from the system is assured by introducing an alcohol or other solvent which is absorbed by the particles, causing them to swell so they may be readily separated by filtering. "Viscotrol" is referred to as a "rheological material" by Bergishagen et al. in U.S. Pat. No. 5,443,748, which employs it in several examples for cleaning paint delivery systems.

U.S. Pat. No. 4,572,744 discloses that the Sandjet® process is a well known and successful process for the in-situ cleaning of the interior surfaces of conduits used for the transport and/or processing of fluids, solids or a mixture thereof. The conduits thus cleaned include fired heater tubes used in hydrocarbon or chemical processing, pipelines, heat exchange tubes and the like. In the practice of the Sandjet® process for such in-situ cleaning operations, cleaning particles are entrained in a propelling fluid stream and are introduced into the conduit to be cleaned at a velocity sufficient to effect the desired cleaning action. In furnace tube applications, the Sandjet® process is used to decoke and clean furnace tubes. By the use of steel shot or other suitable cleaning materials, the Sandjet® process can achieve a desirable decoking action without undue abrasion of the straight sections or of the return bends of such furnace tubes. Dominick in U.S. Pat. No. 4,572,744 discloses that improvements are needed in the art to enable the Sandjet® process to be employed with enhanced reliability in the decoking of difficult-to-remove deposits, without resulting in an unacceptable level of abrasion of the tubes, particularly the bends of said tubes. One approach to the development of improvements enhancing the Sandjet® process resides in the use of new cleaning agents to achieve an advantageous balance of desired cleaning action and undesired abrasive action. Some such agents would have an improved cleaning action over that achieved by steel shot, while avoiding the abrasive action of materials such as flint.

U.S. Pat. Nos. 5,505,749 and 5,509,971 to Kirshner et al. disclose the use of a major amount of a granular relatively soft abrasive having a Mohs hardness of less than 4 and a minor portion of a granular hard abrasive having a Mohs hardness of greater than 5. U.S. Pat. No. 5,234,470 to Lynn et al. discloses a granulated composite, in particular, a flexible open cell water-foamable material and an abrasive mineral such as garnet.

In spite of the above known compositions and techniques, the cleaning art for fluid transport systems is in need of a better way to remove as completely as possible the deposits and build-up from the tubes, piping, pumps and filters of the fluid transport systems. It would be desirable to provide cleaning methods and compositions that would completely clean the old deposits and buildup from the inside of such fluid transport systems, without damaging any permanent surfaces.

PROBLEM TO BE SOLVED BY THE INVENTION

It would be desirable to be able to clean an internal surface of fluid delivery or transport systems, and parts thereof, more rapidly and effectively without damaging the underlying surface. It would also be desirable to be able to more finely control or tailor the abrasive properties of the media to balance its ability to remove a particular coating without attacking a particular surface material.

It would be desirable to accomplish this without using chemicals that present environment or health problems. It would be desirable to be able to economically manufacture and customize such cleaning particles for a particular application.

SUMMARY OF THE INVENTION

The above objects are achieved by providing an abrasive media that comprises a polymeric core surrounded by a layer or shell of hard inorganic particles. The media can be propelled against or along the internal surface by a fluid carrier medium, including liquids, gases, or mixtures of gases and liquids, to remove the unwanted surface material.

This invention can be used for removing adherent materials, for example, residues, deposits, scale, soot, fouling, contaminants, biogrowth, and other unwanted materials from various internal surfaces. Contaminants to be removed from a surface may include any objectionable substance attached to the surface.

In accordance with the present invention, there is provided a method of cleaning interior surfaces of fluid delivery or transport systems and lines and parts thereof The method comprises passing through the system an abrasive cleaner composition comprising at least one fluid carrier containing abrasive particles as described herein to abrade the deposited material to be removed from the interior surfaces of the system.

In one embodiment, the abrasive media may be propelled by a liquid along a surface such as the interior walls of a pipe, to remove adherent materials.

The compositions of the present invention may be advantageously utilized in cleaning the lines and tanks of manufacturing plants as well as for other cleaning purposes where some degree of abrasive action is required. The relatively low viscosity of the cleaning compositions of the present invention simplifies their disposal or recycling. The use of the abrasive particles in an aqueous vehicle avoids the use of toxic solvents. The abrasive particles of this invention are particularly effective in removing adherent material while not damaging the surfaces being cleaned. These and other advantages of the present invention will be readily apparent from the detailed description which follow.

DETAILED DESCRIPTION OF THE INVENTION

Figure 1:
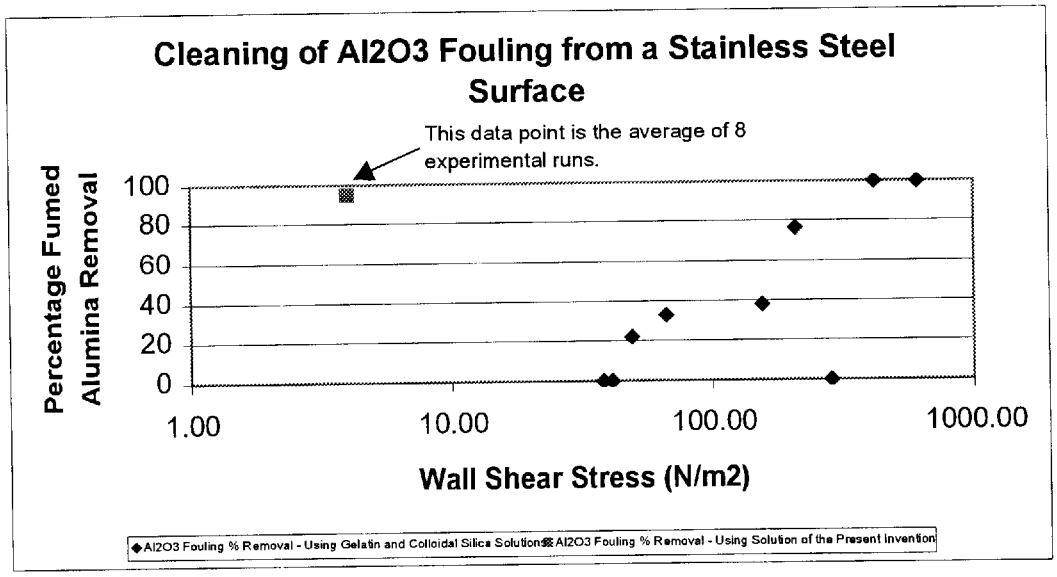
FIG. 1 shows a comparison of a cleaning solution according to the present invention to other cleaning solutions, with respect the percentage of $Al_2O_3$ fouling removal from a stainless steel surface with respect to solution flow wall shear stress.

There is disclosed herein a method for cleaning unwanted deposits from the interior surface of conduits, vessels and the like, especially when used for transporting liquids. The method includes the steps of providing a cleaning composition comprising a vehicle having a particulate material, described below, dispersed therein and establishing and maintaining a flow of the cleaning composition through the equipment to be cleaned.

The vehicle for the particulate media preferably comprises a liquid, including organic solvents or aqueous carriers (both hereinafter referred to as a "liquid vehicle"). In yet other instances the vehicle may be acidic or alkaline. In yet other instances the vehicle may contain a gas, such as air, nitrogen or steam. The composition may further include ancillary ingredients such as detergents, surfactants, sequestriants, or thickeners.

The abrasive cleaner and/or abrasive-containing cleaning composition has typical concentrations of the abrasive particles in the range from about 1 to 50, preferably 2 to 30 percent by weight of the cleaner or composition, depending on the particular application, type of deposit, time involved, etc. All such weight percentages are based on the total of all components for either the abrasive cleaner or abrasive-containing cleaning compositions. The abrasive cleaner and/or abrasive-containing cleaning composition of this invention may also contain surfactants. Anionic, cationic and nonionic surfactants are suitable for use in these cleaner compositions, with the selection of the type of surfactant based on the deposited material that is to be removed from the fluid delivery system. Surfactants are generally characterized by the ionic charge carried by the compound. Anionic surfactants such as carboxylates, sulfonates, sulfates, and protein hydrolysates carry a negative charge. Some nonlimiting examples of anionic surfactants include the dimethylethanolamine salt of dodecylbenzenesulfonic acid, sodium dioctylsulfosuccinate, sodium dodecyl benzene sulfonate, and salts of ethoxylated nonylphenol sulfate. Cationic surfactants such as mono-, di-, and polyamines, imidazolines, and quaternary ammonium salts carry a positive charge. Nonionic surfactants such as those derived from carboxylic acids, amides, esters, acetylenic polyols and polyalkylene oxides carry no ionic charge. Some nonlimiting examples of nonionic surfactants include 4,7-dimethyl-5-decyn-4,7-diol, 2,4,7,9-tetramethyl-5-decyn-4,7-diol which are commercially available from Air Products and Chemicals under the tradename SURFYNOL. Typically, surfactants are present in the abrasive cleaner and/or abrasive-containing cleaning composition and can also be present in the pretreatment fluid in an amount from about 0.1 to 5 percent, preferably from about 0.5 to 3 percent by weight of the composition. A preferred surfactant is N,N,N-triethylethanaminium salt with 1,1,2,2,3,3,4,4,5,5,6,6,7,7,8,8,8-heptadecafluoro-1-octanesulfonic acid (1:1). Preferred sequestering agents are Hydroxybenzenesulfonic acid salt derivatives.

The abrasive cleaner and/or abrasive-containing cleaning compositions of the present invention can also contain acids, including organic acids, or alkali materials to aid in the removal of the unwanted deposited materials from the inner surfaces of a fluid delivery system. Typically, acids or alkali materials may be present in these cleaner compositions up to about 20 percent by weight. Useful acids may include formic acid, acetic acid, lactic acid, phosphoric acid, sulfamic acid, carbonic acid, methanoic acid, and hydroxyacetic acid. Some useful alkali materials include sodium hydroxide, potassium hydroxide, and amines such as those mentioned above.

In general it will be preferred that the particulate matter comprise between 2 and 30 weight volume percent of the composition although, as stated above, particular applications may require greater or lesser amounts. In implementing the process, a flow of the cleaning composition may be established through the vessel by pumping the material there through. In those instances where the vessel is a tube it may be advantageous to maintain a linear flow velocity of at least 50 feet per minute there through, preferably greater than 100 feet per minute. The flow of the abrasive cleaner or abrasive-containing cleaner composition is typically be sufficient to inhibit the settling of abrasive particles and to assure at least some turbulence to cause the particles to rub against the internal surfaces of the fluid delivery or transport system.

The vehicle is preferably a solvent or dispersant for at least some components of the material to be removed from an internal surface and for the aforementioned abrasive polymeric material. As mentioned above, the vehicle may be organic or inorganic depending upon the particular cleaning task. Among the organic materials that may be used are solvents such as aliphatic hydrocarbons, aromatic hydrocarbons, lactones such as butyrolactone, lactams, particularly pyrrolidones, terpenes, alcohols, organic acids, amines, amides, ketones, aldehydes, esters, halogenated solvents, ethers, glycols and the like either taken singly or in combination. Some particular solvents include aliphatic solvents such as hexane, heptane, naptha, and mineral spirits; aromatic solvents such as toluene, xylene, SOLVESSO 100, and SOLVESSO 150 (both are aromatic hydrocarbon solvents commercially available from Chemcentral Corp.); alcohols such as ethyl, methyl, n-propyl, isopropyl, n-butyl, isobutyl and amyl alcohol, m-pyrol, and 2-amino-2-methyl-1-propanol; esters such as ethyl acetate, n-butyl acetate, isobutyl acetate, isobutyl isobutyrate, butyl lactate, and oxohexyl acetate; ketones such as acetone, methyl ethyl ketone, methyl isobutyl ketone, diisobutyl ketone, methyl n-amyl ketone, and isophorone. Additional solvents include glycol ethers and glycol ether esters such as ethylene glycol monobutyl ether, diethylene glycol monobutyl ether, ethylene glycol monohexyl ether, propylene glycol monomethyl ether, propylene glycol monopropyl ether, ethylene glycol monobutyl ether acetate, propylene glycol monomethyl ether acetate, and dipropylene glycol monomethyl ether acetate. Also useful are aliphatic dibasic esters such as DBE-3 from DuPont.

Inorganic vehicles will generally be aqueous based and can be acidic or alkaline. In some instances, it may be advantageous to blend organic and aqueous solvents. From the foregoing it should be apparent that there are a wide variety of vehicles which may be employed in the present invention. The principal requirements for solvent selection are that the solvent not dissolve the organic, polymeric particulate material and that it not damage the system being cleaned. Within these bounds one can readily select a variety of solvent materials.

In its broadest aspect, the abrasive media ("core/shell particles") of the present invention comprises a polymeric core surrounded by a shell of inorganic microparticles. The polymeric core can be any naturally occurring or synthetic polymer such as, for example, olefin homopolymers and copolymers, such as polyethylene, polypropylene, polyisobutylene, polyisopentylene and the like; polyfluoroolefins such as polytetrafluoroethylene, polyvinylidene fluoride and the like, polyamides, such as, polyhexamethylene adipamide, polyhexamethylene sebacamide and polycaprolactam and the like; acrylic resins, such as polymethylmethacrylate, polyethylmethacrylate and styrene-methylmethacrylate or ethylene-methyl acrylate copolymers, ethylene-ethyl acrylate copolymers, ethylene-ethyl methacrylate copolymers, polystyrene and copolymers of styrene with unsaturated monomers mentioned below, polyvinyltoluene, cellulose derivatives, such as cellulose acetate, cellulose acetate butyrate, cellulose propionate, cellulose acetate propionate, and ethyl cellulose; polyvinyl resins such as polyvinyl chloride, copolymers of vinyl chloride and vinyl acetate and polyvinyl butyral, polyvinyl alcohol, polyvinyl acetal, ethylene-vinyl acetate copolymers, ethylene-vinyl alcohol copolymers, and ethylene-allyl copolymers such as ethylene-allyl alcohol copolymers, ethylene-allyl acetone copolymers, ethylene-allyl benzene copolymers ethylene-allyl ether copolymers, ethylene-acrylic copolymers and polyoxy-methylene, polycondensation polymers, such as, polyesters, including polyethylene terephthalate, polybutylene terephthalate, polyurethanes and polycarbonates. Styrenic or acrylic polymers are preferred. Polystyrene and polymethylmethacrylate are especially preferred.

The polymeric core can be selected in order to provide desirable properties. For instance, polymers are well known which are soft or hard, elastic or inelastic, etc. It can be particularly advantageous to crosslink the polymer in order to increase it's strength and make it resistant to fracture and to make the polymer insoluble in any solvent. In its broadest aspect, the abrasive media of the present invention encompasses the use of a polymeric core having a hardness of less than 5.0, preferably less than 4.0 and even less than 3.0 on the Mohs scale The shell of the abrasive media of this invention, which adheres to the polymeric core, is an inorganic particulate which can act as a hard abrasive to provide a grit which abrades the surface in a controlled fashion without scratching or wearing the mechanical integrity of the surface being cleaned. In its broadest aspect, the media of the present invention encompasses the use of an inorganic particulate having a hardness of at least 5.0, preferably at least 6.0 and even about 7.0 and above on the Mohs scale. Non-limiting examples include aluminum oxide, silicon carbide, tungsten carbide, silica, alumina, alumina-silica, tin oxide, titanium dioxide, zinc oxide or garnet and the like. The preferred hard abrasive is colloidal silica.

The abrasive effectiveness of the core/shell particles of the present invention may depend on its size, hardness, and momentum during use. The size of polymer particles utilized will depend upon the particular application. However it has generally been found that larger particles provide for a more rapid cleaning action as compared to smaller particles. However it should be kept in mind that as the particles get larger it becomes more difficult to maintain them in a dispersed form in the vehicle and very large particles tend to clog pumps, lines and the like. Larger particles may require pumps with clearances or tolerances that allow the handling of slurries without clogging. Although the present invention is not limited to any particular size of particles, as a general rule it has been found that for systems using reciprocating or impeller type pumps particle sizes of 1000 microns or less generally function the best and that particles within a size range of 20 to 200 microns are usually the more preferred, most preferably about 30 to 150 microns (on average). It should be noted however, that many new delivery systems employ diaphragm type pumps, and that pumps of this type are less prone to clogging of the particles than are heretofore employed pumps. Consequently, in a diaphragm pumped system, relatively large particles of polymeric material (i.e., as large as ½ inch diameter) may be employed. The fact that polymeric materials used in the core/shell particles of the type employed herein are of relatively low density (typically no greater than 1.5) helps to prevent them from settling out even if they are large.

Use of a polymeric "abrasive" core/shell material confers particular advantage in a cleaning process. Since the particles are primarily polymeric, they generally have a low adhesion to metallic parts such as components of a delivery system thereby minimizing rinse steps in the cleaning process and reducing contamination. The relatively low density of the polymeric material prevents settling out, thereby allowing the composition to be shipped, stored and utilized without numerous mixing steps. Most organic polymers useful in the present invention have a specific gravity of 1.5 or less and many have a specific gravity close to one whereas most of the commonly employed inorganic abrasive materials have specific gravities greater than 2.5. Because of the fact that the particulate material of the present invention remains in suspension readily, the need for resins or other thickening materials is minimized, thereby resulting in a savings of cost and facilitating waste disposal and solvent recovery in addition to preventing contamination. Minimization of resins and/or thickeners results in a cleaner of lower viscosity. Such low viscosity material is easy to pump through the system and is capable of reaching and cleaning narrow passages in the system. Preferably, the compositions of the present invention have a viscosity comparable to water, preferably 5 to 100 cp. However, viscosities can range from 1 to thousands of centipoise, depending on the application and the pump used.

Any suitable method of preparing core/shell particles having a polymeric core adherently covered with a shell of inorganic particles may be used to prepare the particulate media for use in accordance with this invention. For example, suitably sized polymeric particles may be passed through a fluidized bed or heated moving or rotating fluidized bed of inorganic particles, the temperature of the bed being such as to soften the surface of the polymeric particles thereby causing the inorganic particles to adhere to the polymer particle surface. Another technique suitable for preparing polymer particles surrounded by a layer of inorganic particles is to spray dry the particles from a solution of the polymeric material in a suitable solvent and then before the polymer particles solidify completely, pass the particles through a zone of inorganic particles wherein the coating of the polymeric particles with a layer of the inorganic particles takes place. Another method to coat the polymer particles with a layer of inorganic particles is by Mechano Fusion.

A still further method of preparing the particulate media in accordance with this invention is by limited coalescence. This method includes the "suspension polymerization" technique and the "polymer suspension" technique. In the "suspension polymerization" technique, a polymerizable monomer or monomers are added to an aqueous medium containing a particulate suspension of inorganic particles to form a discontinuous (oil droplets) phase in a continuous (water) phase. The mixture is subjected to shearing forces by agitation, homogenization and the like to reduce the size of the droplets. After shearing is stopped an equilibrium is reached with respect to the size of the droplets as a result of the stabilizing action of the inorganic particulate stabilizer in coating the surface of the droplets and then polymerization is completed to form an aqueous suspension of polymeric particles in an aqueous phase having a uniform layer thereon of inorganic particles. This process is described in U.S. Pat. Nos. 2,932,629, 5,279,934 and 5,378,577 incorporated herein by reference.

In the "polymer suspension" technique, a suitable polymer is dissolved in a solvent and this solution is dispersed as fine water-immiscible liquid droplets in an aqueous solution that contains inorganic particles as a stabilizer. Equilibrium is reached and the size of the droplets is stabilized by the action of the inorganic particles coating the surface of the droplets. The solvent is removed from the droplets by evaporation or other suitable technique resulting in polymeric particles having a uniform coating thereon of inorganic particles. This process is further described in U.S. Pat. No. 4,833,060 issued May 23, 1989, assigned to the same assignee as this application and herein incorporated by reference.

In practicing this invention, using the suspension polymerization technique, any suitable monomer or monomers may be employed such as, for example, styrene, vinyl toluene, p-chlorostyrene; vinyl naphthalene; ethylenically unsaturated mono olefins such as ethylene, propylene, butylene and isobutylene; vinyl halides such as vinyl chloride, vinyl bromide, vinyl fluoride, vinyl acetate, vinyl propionate, vinyl benzoate and vinyl butyrate; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methyl-alphachloroacrylate, methyl methacrylate, ethyl methacrylate and butyl methacrylate; acrylonitrile, methacrylonitrile, acrylamide, vinyl ethers such as vinyl methyl ether, vinyl isobutyl ether and vinyl ethyl ether; vinyl ketones such as vinyl methylketone, vinyl hexyl ketone and methyl isopropyl ketone; vinylidene halides such as vinylidene chloride and vinylidene chlorofluoride; and N-vinyl compounds such as N-vinyl pyrrole, N-vinyl carbazole, N-vinyl indole and N-vinyl pyrrolidone, divinyl benzene, ethylene glycol dimethacrylate, mixtures thereof; and the like. Preferred are styrene or methyl methacrylate.

If desired, a suitable crosslinking monomer may be used in forming polymer particles by polymerizing a monomer or monomers within droplets in accordance with this invention to thereby modify the polymeric particle and produce particularly desired properties. Typical crosslinking monomers are aromatic divinyl compounds such as divinylbenzene, divinylnaphthalene or derivatives thereof; diethylene carboxylate esters and amides such as diethylene glycol bis (methacrylate), diethylene glycol diacrylate, and other divinyl compounds such as divinyl sulfide or divinyl sulfone compounds.

In the suspension polymerization technique, other addenda are added to the monomer droplets and to the aqueous phase of the mass in order to bring about the desired result including initiators, promoters and the like which are more particularly disclosed in U.S. Pat. Nos. 2,932,629 and 4,148,741, both of which are incorporated herein in their entirety.

Useful solvents for the polymer suspension process are those that dissolve the polymer, which are immiscible with water and which are readily removed from the polymer droplets such as, for example, chloromethane, dichloromethane, ethyl acetate, propyl acetate, vinyl chloride, methyl ethyl ketone, trichloromethane, carbon tetrachloride, ethylene chloride, trichloroethane, toluene, xylene, cyclohexanone, 2-nitropropane and the like. Particularly useful solvents are dichloromethane, ethyl acetate and propyl acetate because they are good solvents for many polymers while at the same time, being immiscible with water. Further, their volatility is such that they can be readily removed from the discontinuous phase droplets by evaporation or boiling.

The quantities of the various ingredients and their relationship to each other in the polymer suspension process can vary over wide ranges. However, it has generally been found that the ratio of the polymer to the solvent, during preparation, should vary in an amount of from about 1 to about 80% by weight of the combined weight of the polymer and the solvent and that the combined weight of the polymer and the solvent should vary with respect to the quantity of water employed in an amount of from about 25 to about 50% by weight. The size and quantity of the inorganic particulate stabilizer depends upon the size of the particles of the inorganic particulate and also upon the size of the polymer droplet particles desired. Thus, as the size of the polymer/solvent droplets are made smaller by high shear agitation, the quantity of solid colloidal stabilizer is varied to prevent uncontrolled coalescence of the droplets and to achieve uniform size and narrow size distribution of the polymer particles that result. The suspension polymerization technique and the polymer suspension technique herein described are the preferred methods of preparing the particulate media having a core/shell structure comprising a polymeric core with a shell of inorganic particles for use in accordance with this invention. These techniques provide particles having a predetermined average diameter anywhere within the range of from 10 micrometer to about 2000 micrometers with a very narrow size distribution. The coefficient of variation (ratio of the standard deviation to the average diameter), as described in U.S. Pat. No. 2,932,629, referenced previously herein, is normally in the range of about 15 to 35%.

In a cleaning method according to the present invention, the abrasive-containing composition is passed or propelled through the internal space, and past the interior surfaces, of a fluid delivery or transport system, or part thereof. If the flow rate of the passing step for the abrasive particles through the fluid delivery system is too low, then the scrubbing action of the abrasive cleaner may be insufficient for adequate cleaning. If the flow rate is too high, damage may occur to interior surfaces of valves, gauges or filters of the system.

Optionally, a rinsing step can be used, following cleaning employing at least one fluid that is effective in displacing the abrasive cleaner or abrasive-containing cleaning composition and in removing the abrasive particles from the system.

Optionally, the method may additionally include a first step of pretreating by soaking with or circulating through the system a liquid capable of softening or loosening the material to be removed from the fluid delivery system. This liquid can be referred to as a "pretreatment fluid composition", but it should be understood that a pretreatment fluid composition can be circulated through the system as well as be used in a static soak mode.

The passing step to abrade the deposits may be continued for as long as it takes to remove the unwanted deposits and will depend on the particular application. For example, times greater than 72 hours may be needed in some cases. Typically, times range from about 10 minutes to 36 hours.

As mentioned above, the cleaning method of this invention can optionally include a first step of contacting the inside surfaces of the fluid delivery system with a pretreatment fluid composition, also referred to as pretreatment fluid, capable of softening or loosening the deposits that are to be cleaned from the internal surfaces of the delivery system for a time sufficient to soften or loosen such deposits. It should be noted that the pretreatment fluid may serve as the carrier for the core/shell abrasive particles of the abrasive cleaner to form an "abrasive-containing cleaning composition" of this invention. In this embodiment, the pretreatment fluid is first used to soften the deposited material to be removed from the fluid delivery system, then abrasive particles are added to the pretreatment fluid to be circulated in the passing step as is the abrasive cleaner.

The pretreatment fluid can be a mixture of one or more organic solvents and/or water, surfactants, and optionally other materials such as acids or alkali materials. Organic solvents, surfactants, acids, and alkali materials that are suitable for the abrasive cleaner composition are also suitable for the pretreatment fluid. This is particularly suitable where the abrasive particles are added to the pretreatment fluid to form the abrasive-containing cleaner composition. The pretreatment fluid may be used at ambient temperature (about 74° F. 23° C.), but it may be heated up to about 130° F. (55° C.) to increase its effectiveness.

The purpose of circulating and/or exposing the fluid delivery system to a pretreatment fluid is to chemically remove as much of the deposits or unwanted material as possible and sufficiently soften any remaining deposits to aid in the removal of these residual deposits with the abrasive cleaner composition or the abrasive-containing cleaning composition, which preferably follows as a separate step. In order to achieve maximum cleaning, it has been found that no more than 24 hours exposure to the pretreatment fluid is normally required, although longer soak times may be employed when needed.

After the abrasive particles are passed through the fluid delivery system to remove the deposits, a rinse step can be performed in the fluid delivery system cleaning process of this invention for preferably complete removal of the abrasive particles from the fluid delivery system.

The process of this invention is useful for a wide variety of applications. Industrial applications where internal surfaces need to be cleaned include, for instance for example, in the food (e.g., dairy and beverages such as beer and soda), pharmaceuticals, oil, imaging, power, automotive, marine, and paint/coating industries, as well as coatings, polymer and chemical manufacturing pipelines in general. The invention is useful in paper manufacturing, the manufacture of imaging media such as photographic films and papers, ink-jet receivers, and the manufacture of thermal imaging materials, for example, for health imaging and the like. Specific examples of materials that can be cleaned are residues from inks and pigments, petroleum and components thereof. Thus, the invention can be used, for example, to clean pipelines or conduits used in transporting or processing petroleum. It can be used to clean lines in power plants or in marine vehicles. The invention is especially useful where low levels of contamination are unacceptable such as in the pharmaceutical, food, imaging, and electronics industries.

In one embodiment, a method according to the present invention is used in the inkjet paper manufacturing industry to remove metallic oxide fouling from 316 stainless steel, titanium, and Teflon® fluoropolymer surfaces.

Fluid delivery systems are used in many industrial and commercial applications. A particular example of a fluid delivery system is the paint fluid delivery system, for example, as disclosed in U.S. Pat. No. 5,993,562 to Roelofs et al. For paint fluid delivery systems, there are generally two basic types, circulating systems, sometimes called re-circulating or "recirc" systems, and non-circulating or "dead head" systems. Typically, in circulating fluid delivery systems, the paint or coating is continuously re-circulated from the main supply vessel, or tank, through piping or tubing to the coating applicator and then returned to the supply tank through the return line. The fluid is continuously flowing through the lines from the supply tank to the coating applicator and then back to the supply tank. In a "dead head" fluid delivery system, the coating is delivered from the supply vessel through the piping to the coating applicator. The fluid only moves when the coatings applicator is operating, otherwise the fluid remains static in the fluid supply line.

The coatings can be delivered through the fluid delivery systems by the use of pumps, such as positive displacement pumps, piston pumps or turbine pumps. In non-circulating fluid delivery systems, sometimes pressure pots are used instead of a pump. A pressure pot maintains a pressure head of compressed air above the coating in the pot. When coating is used at the applicator, the fluid pressure drops in the supply line and more fluid is pushed into the supply line by the pressure head in the pressure pot, this maintains a constant pressure in the entire paint supply system. Typically, the paint fluid delivery system includes piping or tubing, filters, valves, gauges, and fluid supply vessels or tanks. By the term "enclosed paint system", we mean to include any delivery system employing tubes or ducts to deliver fluid with carried materials, like paint, including both re-circulating systems common in the art and "dead head" systems or portions of systems in which such fluid is delivered or conveyed but not re-circulated. Any type of liquid coating may be found in a paint fluid delivery system. For example, primers, topcoats such as monocoat colorcoats, basecoats, electrocoats, and clearcoats, including both solvent-borne and waterborne materials, typically are moved through paint fluid delivery systems.

The invention will be further described by reference to the following examples which are presented for the purpose of illustration only and are not intended to limit the scope of the invention.

EXAMPLE 1

This example illustrates the synthesis of various core/shell particles for use in a method according to the present invention.

Preparation of 50 $\mu$m Beads

Inhibitor is removed from a mixture of 990 g of styrene and 3960 g divinylbenzene (55% grade from Dow Chemical Co.) by slurrying with 200 g of basic aluminum oxide for 15 minutes followed by filtering off the aluminum oxide. 131.6 g of benzoyl peroxide (sold as Lucidol 75® by Pennwalt Corp) are then dissolved in this uninhibited monomer mixture. In a separate vessel is added 7,100 g of demineralized water to which is added 28.9 g of poly(2-methylaminoethanol adipate), and 47.0 g of Ludox TM®, a 50% colloidal suspension of silica sold by DuPont Corp. The uninhibited monomer mixture is added to the aqueous phase and stirred to form a crude emulsion. This is passed through a Gaulin® colloid mill operated at 4.54 l/minute feed rate, 3,300 rev/min and gap setting of 0.0254 cm. To this is added a solution of 16.4 g gelatin dissolved in 492 g of demineralized water. The mixture is heated to 67° C. for 16 hours followed by heating to 90° C. for 4 hours. The resulting solid beads are sieved through a 165 mesh sieve screen to remove oversized beads and the desired beads which pass through the screen are collected by filtration. The filter cake is rinsed with 3,000 g methanol and then vacuum dried at 80° C. for 2 days. The resultant particles are 50 μm in size and are a crosslinked polystyrene core covered with colloidal silica.

Preparation of 50 μm Beads (Comparative)

The beads from above are slurried in 4L of 1N NaOH solution and stirred for 1 hour. The beads are filtered and redispersed in 4L of 0.1N NaOH solution and stirred overnight. The beads are filtered and successively re-slurried in 4L of demineralized water until the filtrate pH is <8.5. The beads are then filtered and dried in a vacuum oven overnight at 80° C. for 2 days. The resultant particles are 50 μm in size and are a crosslinked polystyrene bead. They are without a shell of inorganic particles.

Preparation of 20 μm Beads

In a vessel are added 5,000 g styrene and 66.7 g of benzoyl peroxide (sold as Lucidol 75® by Pennwalt Corp). In a separate vessel is added 6,350 g of demineralized water to which is added 9.47 g of poly(2-methylaminoethanol adipate), 131.8 g of Ludox TM®, a 50% colloidal suspension of silica sold by DuPont Corp., and 1.45 g potassium dichromate The monomer mixture is added to the aqueous phase and stirred to form a crude emulsion. This is passed through a Gaulin® colloid mill operated at 4.54 l/minute feed rate, 3,550 rev/min and gap setting of 0.010 cm. The mixture is heated to 65° C. for 16 hours followed by heating to 85° C. for 4 hours. The resulting solid beads are sieved through a 165 mesh sieve screen to remove oversized beads and the desired beads which pass through the screen are collected by filtration. The filter cake is rinsed with demineralized and then the filter cake is added to demineralized water to form a 20% solids slurry. The resultant particles are 20 μm in size and are a polystyrene core covered with colloidal silica.

Preparation of 40 μm Beads

In a vessel are added 5,000 g styrene and 66.7 g of benzoyl peroxide (sold as Lucidol 75® by Pennwalt Corp). In a separate vessel is added 6,530 g of demineralized water to which is added 5.75 g of poly(2-methylaminoethanol adipate), 50.0 g of Ludox TM®, a 50% colloidal suspension of silica sold by DuPont Corp., and 1.45 g potassium dichromate The monomer mixture is added to the aqueous phase and stirred to form a crude emulsion. This is passed through a Gaulin® colloid mill operated at 4.54 l/minute feed rate, 3,600 rev/min and gap setting of 0.038 cm. The mixture is heated to 65° C. for 16 hours followed by heating to 85° C. for 4 hours. The resulting solid beads are sieved through a 165 mesh sieve screen to remove oversized beads and the desired beads which pass through the screen are collected by filtration. The filter cake is rinsed with 3,000 g methanol and then vacuum dried at 80° C. for 2 days. The resultant particles are 40 μm in size and are a polystyrene core covered with colloidal silica.

Preparation of 80 μm Beads

In a vessel are added 3,850 g styrene, 1,150 g n-butyl acrylate, 16.6 g divinylbenzene and 142 g 2,2'-azobis(2-methylbutyronitrile) (sold as AMBN® by Akzo Corp). In a separate vessel is added 5400 g of demineralized water to which is added 28 g of poly(2-methylaminoethanol adipate), 54 g of Nalcoag 1060®; a 50% colloidal suspension of silica sold by Nalco Chemical Company, and 0.44 g potassium dichromate. The monomer mixture is added to the aqueous phase and stirred to form a crude emulsion. This is stirred vigorously while the mixture is heated to 67° C. for 4 hours followed by heating to 85° C. for 3 hours. The resulting solid beads are collected by filtration. The filter cake is rinsed with demineralized and then the filter cake is vacuum dried at 50° C. for 2 days. The resultant particles are 80 μm in size and are a crosslinked polystyrene-co-butyl acrylate core covered with colloidal silica.

EXAMPLE 2

This Example shows the cleaning of metal oxide fouling films on the interior of a tubular geometry (pipe interior wall), particularly the cleaning of $Al_2O_3$ fouling from a stainless steel surface.

The metal oxide fouling was measured by X-ray fluorescence spectroscopy (XRF). XRF is used for the qualitative identification and quantitative measurement of elements in solids and liquids. The metal oxide fouling ranged in thickness from 10 to 2000 Angstroms thick. To measure the efficiency of the cleaning treatment, the metal oxide fouled surfaces were measured both before and after each cleaning evaluation. In particular, the following experimental procedure was utilized. The pre-cleaning quantity of metal oxide fouling was measured via XRF. The fouled surface was inserted into a solution distribution system. The solution distribution system consisted of a vessel (10 gallon), a positive displacement pump, approximately 30 feet of 0.62 inch inside diameter hose, and several valves (used for diverting flow). The cleaning solutions were placed in the solution distribution system vessel and recycled (pumped through the system back into the vessel) for varying lengths of time. The cleaning solutions were rinsed from the system with water. The post-cleaning quantity of metal oxide fouling was measured via XRF.

Several different cleaning solutions (particle suspensions) were evaluated for the removal of $Al_2O_3$ from 316 stainless steel. The composition of the solutions, viscosity, and temperature during the cleaning test are outlined in Table 1, which shows cleaning solution composition, viscosity and temperature.

TABLE 1

| Cleaning Solution ID | Composition | Solution Viscosity (cP) | Solution Temperature (° F.) |
|---|---|---|---|
| Comparative Solution No.1 (14% colloidal silica) | 12 liters of Colloidal Silica (Ludox TM-50) 30 liters of 400 cP Gelatin solution | 1600 | 105 |
| Comparative Solution No.2 (1.5% colloidal silica) | 1.2 liters of Colloidal Silica (Ludox TM-50) 40 liters of 690 cP Gelatin solution | 1100 | 105 |
| Comparative Solution No.3 (0.5% colloidal silica) | 0.4 liters of Colloidal Silica (Ludox TM-50) 40 liters of 690 cP Gelatin solution | 750 | 105 |
| Comparative Solution No.4 (5.5% colloidal silica) | 2.3 liters of Colloidal Silica powder 40 liters of 275 cP Gelatin solution | 341 | 105 |
| Comparative Solution No.5 (6.5% colloidal silica) | 10.8 liters of Colloidal Silica (Ludox TM-50) 72 liters of 100 cP Gelatin solution | 175 | 105 |
| Comparative | 4.2 liters of Colloidal Silica | 126 | 105 |

TABLE 1-continued

| Cleaning Solution ID | Composition | Solution Viscosity (cP) | Solution Temperature (° F.) |
|---|---|---|---|
| Solution No.6 (2.7% colloidal silica) | (Ludox TM-50) 72 liters of 100 cP Gelatin solution | | |
| Comparative Solution No.7 (1.8% colloidal silica) | 2.8 liters of Colloidal Silica (Ludox TM-50) 72 liters of 100 cP Gelatin solution | 108 | 105 |
| Comparative Solution No.8 (1% colloidal silica) | 1.4 liters of Colloidal Silica (Ludox TM-50) 72 liters of 100 cP Gelatin solution | 100 | 105 |
| Solution of the Present Invention | 2% Polyvinyl Alcohol 15% of the 50 $\mu$m crosslinked polystyrene core covered with 20 nm colloidal silica according to Example 1 10% Colloidal Silica 5% Sequestriant 2% Surfactant 2% 2N NaOH Balance Water | 10 | 80 |

Typically, the cleaning solutions were recycled through the system for 1 hour (actual recycle times are noted in Table 2). The recycle times, flow Reynolds Numbers, solution wall shear stress, and the $Al_2O_3$ fouling percentage removed are provided in Table 2, which show cleaning solution flow duration, Reynolds Number, wall shear stress, and percentage $Al_2O_3$ fouling removal.

TABLE 2

| Cleaning Solution Number | Recycle Flow Time (min.) | Reynolds Number | Wall Shear Stress ($N/m^2$) | Percentage $Al_2O_3$ Removal |
|---|---|---|---|---|
| Comparative Solution No.1 | 10 | 8 | 611 | 100 |
| Comparative Solution No.2 Run 1 | 30 | 12 | 420 | 100 |
| Comparative Solution No.2 Run 2 | 30 | 6 | 210 | 76 |
| Comparative Solution No.3 | 60 | 17 | 286 | 0 |
| Comparative Solution No.4 | 60 | 31 | 156 | 38 |
| Comparative Solution No.5 | 60 | 71 | 66 | 33 |
| Comparative Solution No.6 | 60 | 97 | 50 | 22 |
| Comparative Solution No.7 | 60 | 116 | 41 | 0 |
| Comparative Solution No.8 | 60 | 125 | 38 | 0 |
| Solution of the Current Invention | 60 | 1250 | 4 | 95 (average of 8 experimental runs) |

The Reynolds Number will depend on flow rate, pipe diameter, and viscosity. The percentage $Al_2O_3$ fouling removal is plotted below with respect to the solution flow wall shear stress, as shown in FIG. 1. It is clear from the above example that the cleaning solution of the present invention effectively cleans the $Al_2O_3$ fouling from the 316 stainless steel surfaces with much lower wall shear stresses. This is of benefit for solution distribution systems that have limitations in the flow capabilities (i.e., flow rate and/or viscosity limitations) or for delicate equipment, which might be damaged by the high concentrations/high viscosities of the prior-art silica and gelatin solutions.

The solution of the present invention is a stable suspension, requiring very little vessel agitation to maintain homogeneity and does not phase separate in the solution distribution system. The prior-art silica and gelatin solutions, in comparison, are not stable suspensions, requiring vigorous agitation to maintain homogeneity in a vessel and results in phase separation in the solution distribution system.

EXAMPLE 3

This example shows the cleaning of metal oxide fouling films on the interior of a tubular geometry (pipe interior wall), particularly the cleaning of $Al_2O_3$ fouling from a Teflon® polymer Surface As in Example 2, the metal oxide fouling ranged in thickness from 10 to 2000 Angstroms thick. The same experimental procedure as in Example 2 above was utilized. In particular, the pre-cleaning quantity of metal oxide fouling was measured via XRF. The fouled surface was inserted into the solution distribution system. The solution distribution system consisted of a vessel (10 gallon), a positive displacement pump, approximately 30 feet of 0.62 inch inside diameter hose, and several valves (used for diverting flow). The cleaning solutions were placed in the solution distribution system vessel and recycled (pumped through the system back into the vessel) for varying lengths of time. The cleaning solutions were rinsed from the system with water. The post-cleaning quantity of metal oxide fouling was measured via XRF.

Several different cleaning solutions (particle suspensions and pure solutions) were evaluated for the removal of $Al_2O_3$ from the Teflon® polymer surface. The composition of the solutions, solution viscosity, and temperature during the cleaning test are outlined in Table 3, which shows cleaning solution composition and temperature.

TABLE 3

| Cleaning Solution ID | Composition | Solution Viscosity (cP) | Solution Temperature (° F.) |
|---|---|---|---|
| Comparative Solution No.10 (880 cP gelatin) | 30 liters of 880 cP Gelatin solution | 880 | 105 |
| Comparative Solution No.11 (525 cP gelatin) | 30 liters of 525 cP Gelatin solution | 525 | 105 |
| Comparative Solution No.12 (460 cP gelatin) | 30 liters of 460 cP Gelatin solution | 460 | 105 |
| Comparative Solution No.13 (311 cP gelatin) | 30 liters of 311 cP Gelatin solution | 311 | 105 |
| Comparative Solution No.14 (111 cP gelatin) | 30 liters of 111 cP Gelatin solution | 111 | 105 |
| Comparative Solution No.15 (2.4% colloidal silica) | 2.4 liters of Colloidal Silica (Ludox TM-50) 48 liters of 635 cP Gelatin solution | 671 | 105 |
| Comparative Solution No.16 (2.4% colloidal silica) | 2.4 liters of Colloidal Silica (Ludox TM-50) 48 liters of 100 cP Gelatin solution | 425 | 105 |
| Comparative Solution No.17 (2.4% colloidal silica) | 2.4 liters of Colloidal Silica (Ludox TM-50) 48 liters of 100 cP Gelatin solution | 130 | 105 |
| Solution of the Present Invention | 2% Polyvinyl Alcohol 15% of the 50 μm crosslinked polystyrene core covered with 20 nm colloidal silica according to Example 1 10% Colloidal Silica 5% Sequestriant 2% Surfactant 2% 2N NaOH Balance Water | 10 | 80 |

Typically, the cleaning solutions were recycled through the system for one hour (actual recycle times are noted in Table 4 below). The recycle flow timers, flow Reynolds Number, the calculated solution wall shear stress, and the $Al_2O_3$ fouling percentage removed are provided in Table 4, which shows the cleaning solution flow duration, Reynolds Number, wall shear stress, and percentage $Al_2O_3$ fouling removal.

TABLE 4

| Cleaning Solution Name | Recycle Flow Time (min.) | Reynolds Number | Wall Shear Stress ($N/m^2$) | Percentage $Al_2O_3$ Removal |
|---|---|---|---|---|
| Solution No.10 | 60 | 9 | 224 | 7 |
| Solution No.11 | 60 | 24 | 200 | 0 |
| Solution No.12 | 60 | 13 | 89 | 6 |
| Solution No.13 | 60 | 40 | 118 | 2 |
| Solution No.14 | 60 | 113 | 42 | 0 |
| Solution No.15 | 60 | 19 | 256 | 23 |
| Solution No.16 | 60 | 29 | 163 | 13 |
| Solution No.17 | 60 | 97 | 49 | 11 |
| Solution of the Current Invention | 60 | 1250 | 4 | 37 (average of 8 experimental runs) |

Figure 2:
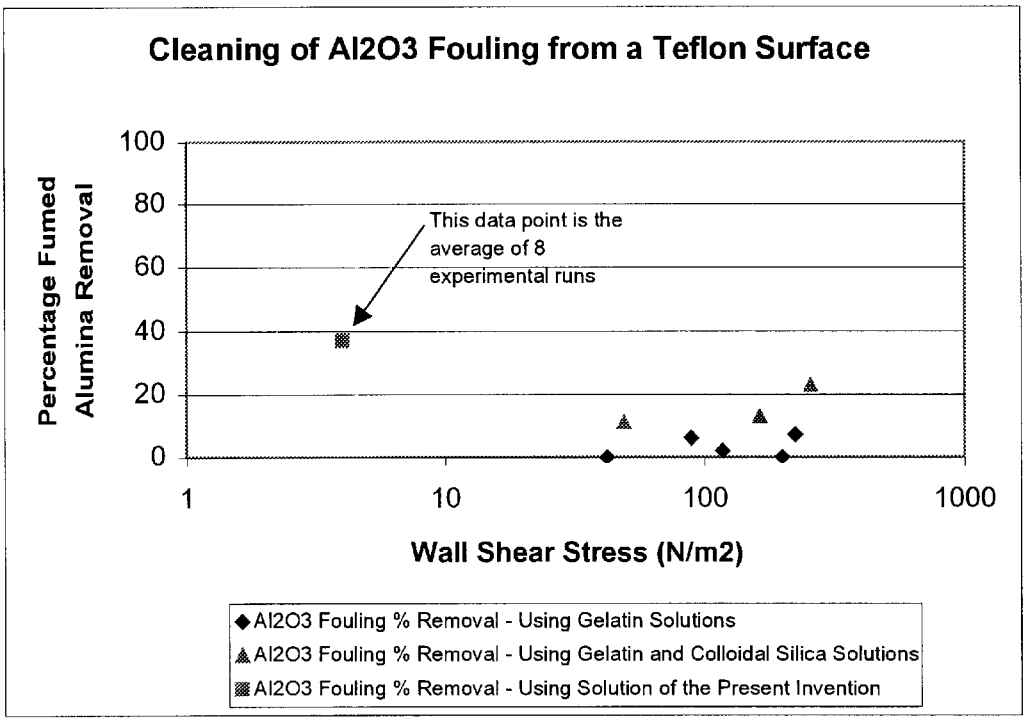
FIG. 2 shows a comparison of a cleaning solution according to the present invention to other cleaning solutions, with respect the percentage of $Al_2O_3$ fouling removal from a Teflon® fluoropolymer surface with respect to solution flow wall shear stress.

The percentage $Al_2O_3$ fouling removal is plotted below with respect to the solution flow wall shear stress, as shown in FIG. 2.

Again, it is clear from the above example that the cleaning solution of the present invention effectively cleans the $Al_2O_3$ fouling from the Teflon® polymer surfaces with much lower wall shear stresses. In fact, in the case of the Teflon® polymer surfaces, the cleaning solution of the present invention is the only one of the solutions that effectively cleans the surface.

EXAMPLE 4

This example provides a comparison of the cleaning efficiency of two cleaning solutions, using crosslinked polystyrene beads with and without a covering of inorganic particles (silica). In this example, the solution of the present invention contains crosslinked polystyrene beads where the exterior surface is covered with silica (inorganic particles). The comparison bead is similar to the above bead, the only difference being the lack of an inorganic particle covering. This comparison was conducted using 316 SS surfaces fouled by the aluminum oxide fouling. The Formulas of the two solutions are outlined in Table 5, which shows cleaning solution composition and temperature.

TABLE 5

| Cleaning Solution Name | Composition | Solution Viscosity (cP) | Solution Temperature (° F.) |
|---|---|---|---|
| Solution of the Present Invention | 2% Polyvinyl Alcohol 15% 50 μm diameter crosslinked polystyrene core covered with 20 nm colloidal silica 10% Colloidal Silica | 10 | 80 |

TABLE 5-continued

| Cleaning Solution Name | Composition | Solution Viscosity (cP) | Solution Temperature (° F.) |
|---|---|---|---|
| | 5% Sequestriant<br>2% Surfactant<br>2% 2N NaOH<br>Balance Water | | |
| Comparison Solution #18 | 2% Polyvinyl Alcohol<br>15% 50 μm diameter crosslinked polystyrene core NOT covered with colloidal silica<br>10% Colloidal Silica<br>5% Sequestriant<br>2% Surfactant<br>2% 2N NaOH<br>Balance Water | 10 | 80 |

Typically, the cleaning solutions were recycled through the system for 1 hour (actual recycle times are noted in Table 6). The recycle flow rates, flow Reynolds Number, the calculated solution wall shear stress, and the $Al_2O_3$ fouling percentage removed are provided in Table 6, which show cleaning solution flow time, Reynolds Number, wall shear stress, and percentage $Al_2O_3$ fouling removal.

TABLE 6

| Cleaning Solution ID | Recycle Flow Time (min.) | Reynolds Number | Wall Shear Stress ($N/m^2$) | Percentage $Al_2O_3$ Removal |
|---|---|---|---|---|
| Solution of the Current Invention | 60 | 1250 | 4 | 95 (average of 8 experimental runs) |
| Solution of the Current Invention | 60 | 1250 | 4 | 44 (average of 4 experimental runs) |

The percentage $Al_2O_3$ fouling removal listed in Table 6 clearly demonstrates that the particles containing the inorganic particles on the outer shell of the polystyrene particles (solution of the present invention) are far more effective than the solution containing particles without inorganic particles on the outer shell.

EXAMPLE 5

This example illustrates that polystyrene beads of various diameter and made from various materials, with a covering of inorganic particles (silica in this case), are effective. In particular, the cleaning efficiency of four cleaning solutions according to the present invention were compared. The primary differences between the solutions was the composition of the crosslinked polystyrene beads and their diameter. This comparison was conducted using 316 SS surfaces and Teflon® polymer surfaces fouled by aluminum oxide fouling. The formulas of the two solutions are outlined in Table 7, which shows Cleaning Solution Composition and Temperature.

TABLE 7

| Cleaning Solution ID | Composition | Solution Viscosity (cP) | Solution Temperature (° F.) |
|---|---|---|---|
| Solution of the Present Invention - Variation 1 | 2% Polyvinyl Alcohol<br>15% 20 micron diameter polystyrene core covered with 20 nm colloidal silica<br>10% Solloidal Silica<br>5% Sequestriant<br>2% Surfactant<br>2% 2N NaOH<br>Balance Water | 10 | 80 |
| Solution of the Present Invention - Variation 2 | 2% Polyvinyl Alcohol<br>15% 40 μm diameter polystyrene core covered with 20 nm colloidal silica.<br>10% Colloidal Silica<br>5% Sequestriant<br>2% Surfactant<br>2% 2N NaOH<br>Balance Water | 10 | 80 |
| Solution of the Present Invention - Variation 3 | 2% Polyvinyl Alcohol<br>15% 50 μm diameter crosslinked polystyrene core covered with 20 nm colloidal silica<br>10% colloidal silica<br>5% sequestriant<br>2% surfactant<br>2% 2N NaOH<br>Balance Water | 10 | 80 |
| Solution of the Present Invention - Variation 4 | 2% Polyvinyl Alcohol<br>15% 80 μm diameter crosslinked polystyrene-co-butyl acrylate core covered with 60 nm colloidal silica.<br>10% colloidal silica<br>5% sequestriant<br>2% surfactant<br>2% 2N NaOH<br>Balance Water | 10 | 80 |

Typically, the cleaning solutions were recycled through the system for 1 hour (actual recycle times are noted in Table 8). The recycle flow rates, flow Reynolds Number, the calculated solution wall shear stress, and the $Al_2O_3$ fouling percentage removed are provided in Table 8, which shows Cleaning Solution Flow, Reynolds Number, Wall Shear Stress, and Percentage $Al_2O_3$ Fouling Removal.

TABLE 8

| Cleaning Solution Name | Recycle Flow Time (min.) | Reynolds Number | Wall Shear Stress ($N/m^2$) | Percentage $Al_2O_3$ Removal from 316 SS | Percentage $Al_2O_3$ Removal From Teflon ® Polymer |
|---|---|---|---|---|---|
| Solution of the Present Invention - Variation 1 - 20 micron | 60 | 1250 | 4 | 10 (one experimental run) | 11 (one experimental run) |
| Solution of the | 60 | 1250 | 4 | 59 (average of 10 | 44 (average of 10 |

TABLE 8-continued

| Cleaning Solution Name | Recycle Flow Time (min.) | Reynolds Number | Wall Shear Stress ($N/m^2$) | Percentage $Al_2O_3$ Removal from 316 SS | Percentage $Al_2O_3$ Removal From Teflon ® Polymer |
|---|---|---|---|---|---|
| Present Invention - Variation 2 - 40 micron | | | | experimental runs) | experimental runs) |
| Solution of the Present Invention - Variation 3 - 50 micron | 60 | 1250 | 4 | 95 (average of 8 experimental runs) | 37 (average of 8 experimental runs) |
| Solution of the Present Invention - Variation 4 - 80 micron | 60 | 1250 | 4 | 93 (average of 4 experimental runs) | 24 (average of 4 experimental runs) |

The percentage $Al_2O_3$ fouling removal listed in Table 8 indicates that all cleaning solutions are able to remove the $Al_2O_3$ fouling. With all of these solutions, an increase in recycle time, will increase the cleaning efficiencies. These data clearly demonstrates that the solution of the present invention is effective at removing pigment or oxide fouling.

The invention has been described in detail with particular reference to certain preferred embodiments thereof, but it will be understood that variations and modifications can be effected within the spirit and scope of the invention.

What is claimed is:

1. A process for removing material from an internal surface of a fluid transport or delivery system, or a part thereof, the method comprising propelling a particulate media, entrained in a fluid, against said internal surface, wherein the particulate media comprises particles having a core/shell structure in which a polymeric core is adherently covered with a shell of inorganic particles.

2. The process according to claim 1 in which the method comprises cleaning the internal surface of a conduit.

3. The process according to claim 1 in which the material to be removed is a pigment-containing material.

4. A process according to claim 1 wherein the surface is the interior surface of a tank.

5. A process according to claim 1 wherein the particles are propelled against the surface by a controlled flow of a fluid comprising water.

6. A process according to claim 1 wherein the material being removed is scale.

7. A process according to claim 1 wherein the material being removed comprises a residue from a component used in a manufacturing plant.

8. A process according to claim 1 wherein the surface is that of a metal or plastic pipe.

9. A process according to claim 1 wherein the fluid comprises a surfactant.

10. A process according to claim 9 wherein the fluid is a liquid vehicle for the particulate media and comprises an organic solvent and/or an aqueous carrier.

11. A process according to claim 10 wherein the fluid further comprises a sequestriant.

12. A process according to claim 10 wherein the fluid further comprises a gas.

13. A process according to claim 10 wherein the fluid is primarily water.

14. A process according to claim 10 wherein the particulate media has an average diameter of 10 to 1000 $\mu$m.

15. A process according to claim 1 wherein the particulate media has an average diameter of 20 to 150 $\mu$m.

16. A process according to claim 1 wherein the particulate media comprises a core with a Moh hardness less than 5.0 surrounded by a shell of particles with a Moh hardness of at least 5.0.

17. A process according to claim 1 wherein the particulate media comprises a shell of particles with a Moh hardness of at least 6.0.

18. A process according to claim 1 wherein the particulate media comprises a shell of particles with a Moh hardness greater than 7.0.

19. A process according to claim 1 wherein the particles are present in a cleaning composition comprising a liquid fluid, in a range of from about 1 to 50 percent by weight of the composition, based on the total of all components in the cleaning composition.

20. A process according to claim 1 wherein the particles have a core that is a styrenic or acrylic polymer.

21. A process according to claim 1 wherein the particles have a core that is crosslinked.

22. A process according to claim 1 wherein the inorganic particles are colloidal silica.

23. A method of removing metallic-oxide fouling from the internal surface of a fluid distribution system in which a particulate media is propelled by a liquid fluid and entrained against said surface, wherein said particulate media comprises particles having a core/shell structure comprising a polymeric core adherently covered with a shell of inorganic particles.

* * * * *

UNITED STATES PATENT AND TRADEMARK OFFICE

CERTIFICATE OF CORRECTION

PATENT NO. : 6,736,905 B2
DATED : May 18, 2004
INVENTOR(S) : Dennis E. Smith et al.

It is certified that error appears in the above-identified patent and that said Letters Patent is hereby corrected as shown below:

Column 21,
Line 60, delete “claim 10” and replace with -- claim 1 --.

Signed and Sealed this

Twenty-fifth Day of October, 2005

JON W. DUDAS
*Director of the United States Patent and Trademark Office*